US011401121B2

(12) United States Patent
Nakamura et al.

(10) Patent No.: US 11,401,121 B2
(45) Date of Patent: Aug. 2, 2022

(54) SHEET TRAY AND IMAGE FORMING DEVICE

(71) Applicant: BROTHER KOGYO KABUSHIKI KAISHA, Nagoya (JP)

(72) Inventors: Kazutoshi Nakamura, Kuwana (JP); Yasuo Fukamachi, Nagoya (JP); Keita Shimizu, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/930,851

(22) Filed: Jul. 16, 2020

(65) Prior Publication Data

US 2021/0016985 A1 Jan. 21, 2021

(30) Foreign Application Priority Data

Jul. 19, 2019 (JP) ..... JP2019-133883

(51) Int. Cl.
*B65H 1/04* (2006.01)
*G03G 15/00* (2006.01)
*B65H 1/26* (2006.01)

(52) U.S. Cl.
CPC ..... *B65H 1/04* (2013.01); *G03G 15/6502* (2013.01); *B65H 1/266* (2013.01); *B65H 2405/11164* (2013.01); *B65H 2511/11* (2013.01)

(58) Field of Classification Search
CPC ... B65H 1/00; B65H 1/04; B65H 1/26; B65H 1/266; B65H 2401/15; B65H 2402/10; B65H 2402/32; B65H 2405/111; B65H 2405/1112; B65H 2405/1116; B65H 2405/11164; B65H 2405/31; B65H 2405/32; B65H 2511/11; G03G 15/6502
See application file for complete search history.

(56) References Cited

U.S. PATENT DOCUMENTS

2004/0247349 A1 12/2004 Takahashi et al.
2005/0052517 A1* 3/2005 Fujioka ..... B41J 13/106 347/104
2006/0071404 A1 4/2006 Kozaki
2007/0086819 A1* 4/2007 Park ..... G03G 15/6502 399/393
2011/0129273 A1* 6/2011 Jang ..... B65H 1/266 271/171
2016/0289016 A1* 10/2016 Washino ..... B65H 1/266
2019/0062082 A1* 2/2019 Murata ..... B65H 3/34

FOREIGN PATENT DOCUMENTS

JP 2004-315230 A 11/2004
JP 2006-062775 A 3/2006

* cited by examiner

*Primary Examiner* — Prasad V Gokhale
(74) *Attorney, Agent, or Firm* — Merchant & Gould P.C.

(57) ABSTRACT

A sheet tray configured to accommodate a sheet includes a first tray, a second tray directly connectable to the first tray, and a third tray directly connectable to the first tray and to the second tray in a state where the second tray is disengaged from the first tray, the third tray being made of metal. The sheet tray is configured to take a first state where the first tray is directly connected to the second tray and a second state where the third tray connects the first tray to the second tray. The sheet tray is configured to accommodate a sheet having a first size in the first state and a sheet having a second size longer than the sheet having the first size in the second state.

16 Claims, 11 Drawing Sheets

SHEET TRAY AND IMAGE FORMING DEVICE

CROSS-REFERENCE TO RELATED APPLICATIONS

This application is based on Japanese Patent Applications No. 2019-133883 filed on Jul. 19, 2019, the entire contents of which are incorporated herein by reference.

TECHNICAL FIELD

The present invention relates to a sheet tray and an image forming device that may use a long sheet.

BACKGROUND ART

In the related art, there is known a sheet tray that may stack a plurality of kinds of lengths of sheets by providing a second tray that is slidable to a first tray. In the sheet tray, the length of the sheet tray may be further increased by using an auxiliary rail.

However, when a sheet tray is adapted to a long sheet, the sheet tray becomes long to reduce the rigidity easily, and attachment and detachment of an image forming device with respect to the device main body become inconvenient.

Here, an object of the present invention is to provide a sheet tray and an image forming device that may accommodate a long sheet and have high rigidity.

SUMMARY OF INVENTION

According to an aspect of the invention, a sheet tray configured to accommodate a sheet includes a first tray, a second tray directly connectable to the first tray, and a third tray directly connectable to the first tray and to the second tray in a state where the second tray is disengaged from the first tray, the third tray being made of metal. The sheet tray is configured to take a first state where the first tray is directly connected to the second tray and a second state where the third tray connects the first tray to the second tray. The sheet tray is configured to accommodate a sheet having a first size in the first state and a sheet having a second size longer than the sheet having the first size in the second state.

According to this sheet tray, the first tray and the second tray are directly connected to each other, so that a short sheet having the first size may be accommodated. The first tray and the second tray are connected to each other by the third tray, so that the sheet tray is lengthened, and a long sheet having the second size may be accommodated. Since the third tray is made of metal, even when the first tray and the second tray are connected to each other by the third tray, the rigidity of the sheet tray may be increased.

According to the sheet tray and the image forming device of the present invention, a long sheet may be accommodated, and the rigidity may be increased.

DESCRIPTION OF EMBODIMENTS

Hereinafter, an embodiment of the present invention is specifically described with reference to the drawings as appropriate.

Figure 1:
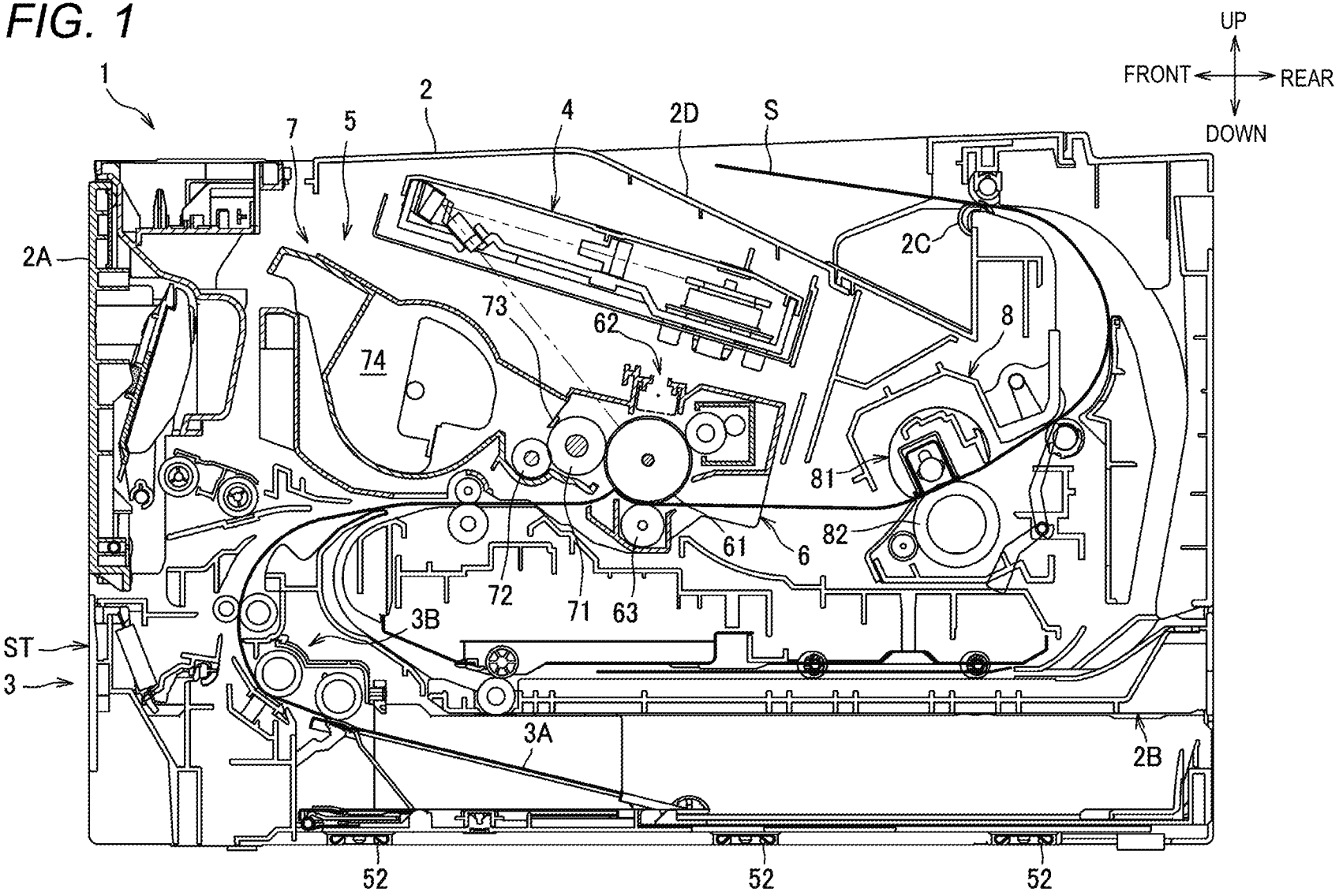
FIG. 1 is a cross-sectional view of an image forming device including a sheet tray according to an embodiment.

As illustrated in FIG. 1, an image forming device 1 is an electrophotographic printer. The image forming device 1 mainly includes a sheet feeding unit 3 for feeding a sheet S in a device main body 2, an exposure device 4, a process unit 5 for transferring a toner image onto the sheet S, and a fixing unit 8 for heat-fixing the toner image transferred onto the sheet S.

The sheet feeding unit 3 is provided in a lower portion in the device main body 2. The sheet feeding unit 3 mainly includes a sheet tray ST, a pressure plate 3A, and a sheet feeding mechanism 3B. The device main body 2 includes a mounting unit 2B on which the sheet tray ST is mounted, and the sheet tray ST is detachably mounted on the mounting unit 2B. The sheet tray ST may stack the sheet S. The sheet S accommodated in the sheet tray ST is lifted by the pressure plate 3A and fed toward the process unit 5 by the sheet feeding mechanism 3B. The sheet S is stacked on the sheet tray ST so that the longitudinal direction of the sheet S is along the left-right direction of FIG. 1.

The exposure device 4 is disposed in the upper portion in the device main body 2 and includes a laser light emission unit (not illustrated), a polygon mirror, a lens, a reflecting mirror, and the like which are not denoted by reference numerals. In the exposure device 4, laser light (see a chain line) based on the image data emitted from the laser light emission unit is scanned on the surface of the photosensitive drum 61 at a high speed so that the surface of the photosensitive drum 61 is exposed.

The process unit 5 is disposed under the exposure device 4 and may be detached from the device main body 2 via an opening (not illustrated) that is opened by rotating a front cover 2A provided in the device main body 2 forward. The process unit 5 includes a drum cartridge 6 and a developing cartridge 7. In the present embodiment, for convenience, the left side of FIG. 1 is "front", the right side is "rear", the front side of the paper is "right", and the back side of the paper is "left". The labels "upper" and "lower" are used based on the installation state of the image forming device 1.

The drum cartridge 6 mainly includes a photosensitive drum 61, a charger 62, and a transfer roller 63. The developing cartridge 7 is configured to be detachably mounted on the drum cartridge 6. The developing cartridge 7 mainly includes a developing roller 71, a feeding roller 72, a thickness regulation blade 73, and a toner accommodation unit 74 that accommodates toner.

In the process unit 5, the surface of the photosensitive drum 61 is uniformly positively charged by the charger 62 and then exposed with the laser light from the exposure device 4 with high speed scanning. As a result, the potential of the exposed portion is lowered, and an electrostatic latent image based on the image data is formed on the photosensitive drum 61. The toner in the toner accommodation unit 74 is fed to a developing roller 71 via the feeding roller 72 and positively charged by friction between the feeding roller 72 and the developing roller 71. The toner fed onto the developing roller 71 enters a gap with the thickness regulation blade 73 according to the rotation of the developing roller 71, is further charged by friction, and is carried on the developing roller 71 as a thin layer having a certain thickness.

The toner carried on the developing roller 71 is fed from the developing roller 71 to the electrostatic latent image formed on the photosensitive drum 61. Accordingly, the electrostatic latent image is visualized so that a toner image is formed on the photosensitive drum 61. The sheet S is conveyed to a portion between the photosensitive drum 61 and the transfer roller 63 so that the toner image on the photosensitive drum 61 is transferred onto the sheet S.

The fixing unit 8 is disposed rearward from the process unit 5 and mainly includes a heating member 81 and a pressure member 82 that holds the sheet S with the heating member 81. In the fixing unit 8, the toner image transferred onto the sheet S is heat-fixed while the sheet S passes through a portion between the heating member 81 and the pressure member 82. The sheet S on which the toner image is heat-fixed is discharged onto a sheet discharging tray 2D by a discharge roller 2C.

Figure 2:
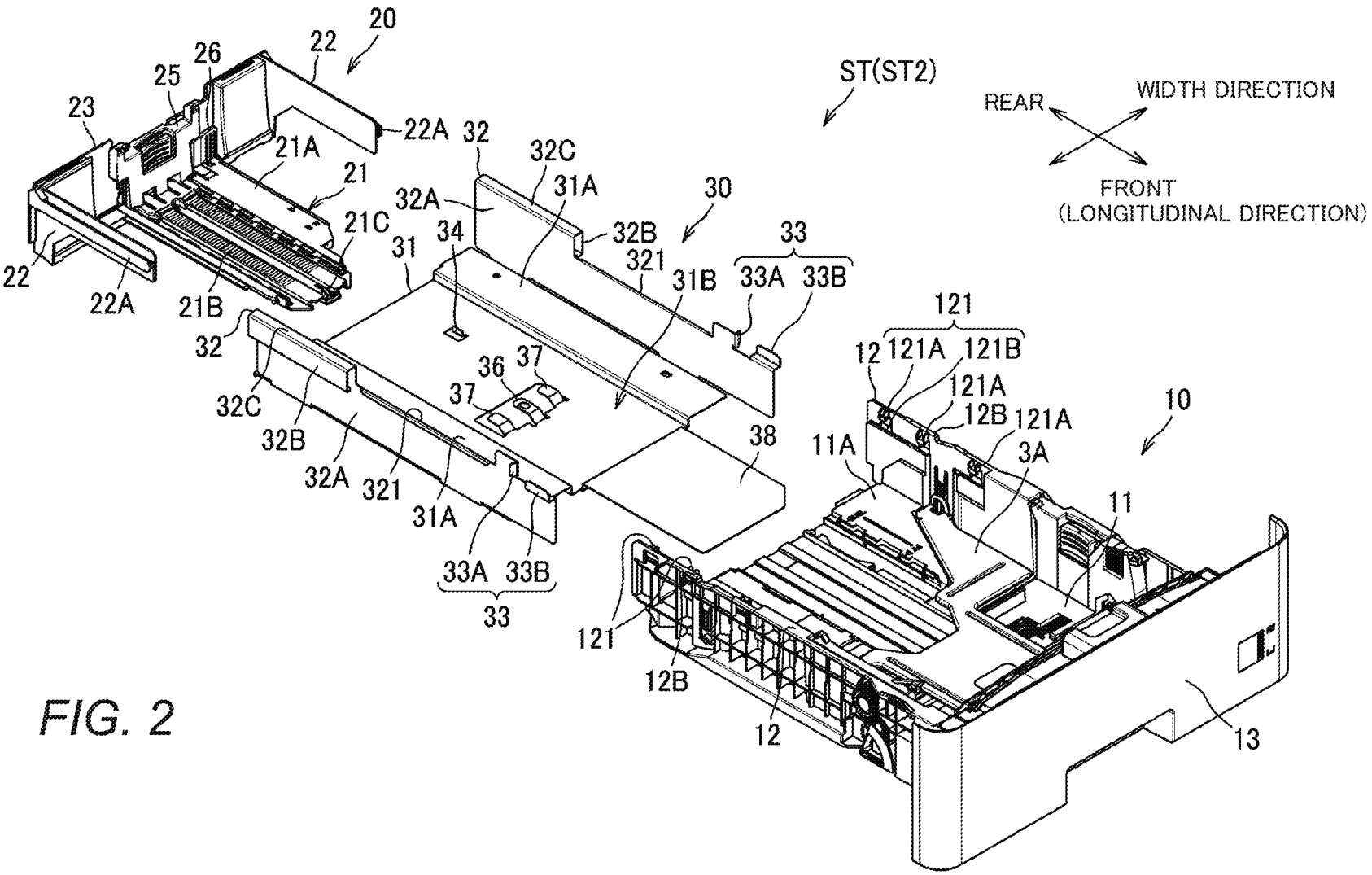
FIG. 2 is an exploded perspective view of the sheet tray in a second state.
Figure 5A:
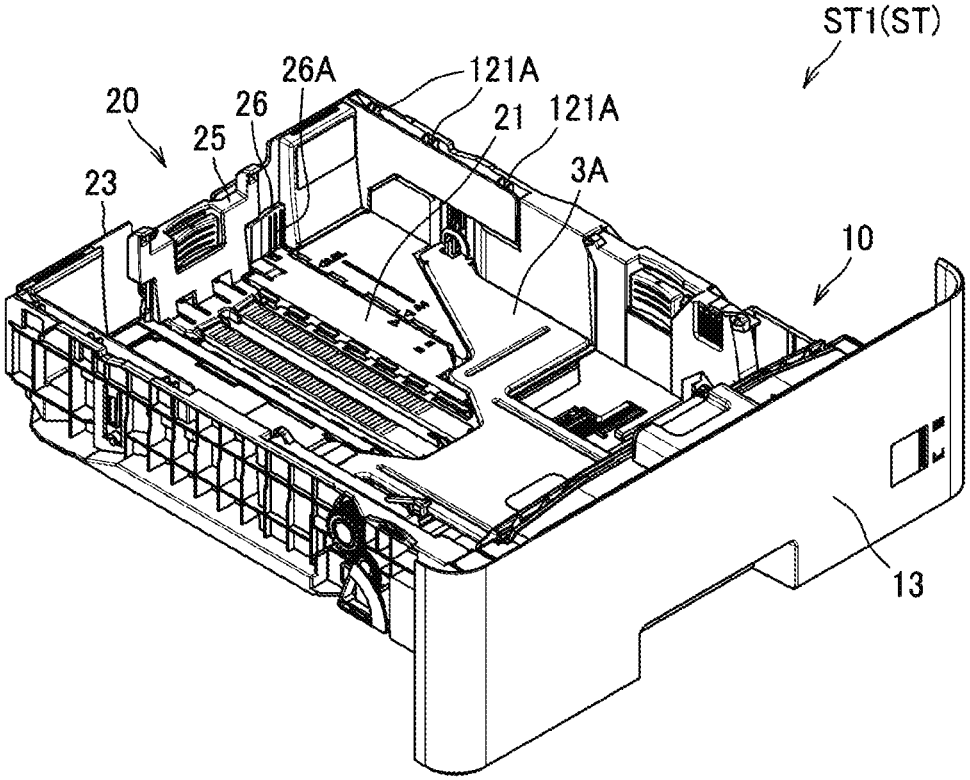
FIG. 5A is a perspective view when a second tray is at a first position in the sheet tray in the first state.
Figure 5B:
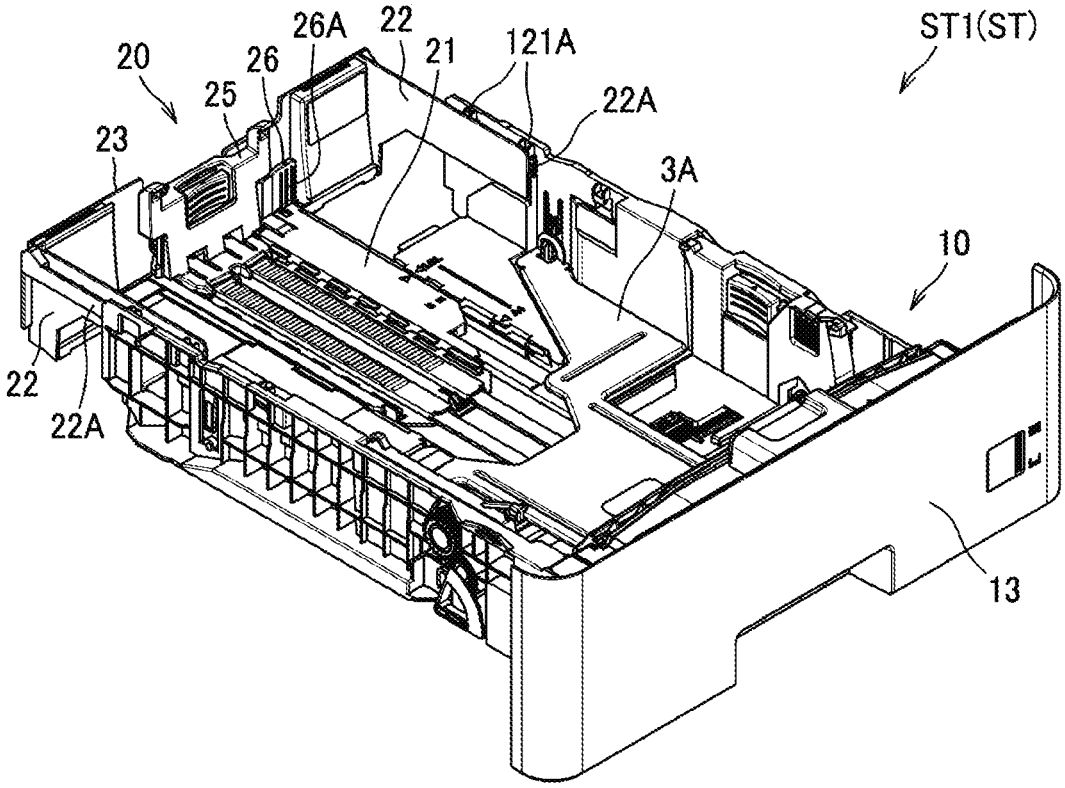
FIG. 5B is a perspective view when a second tray is at a second position in the sheet tray in the first state.
Figure 6:
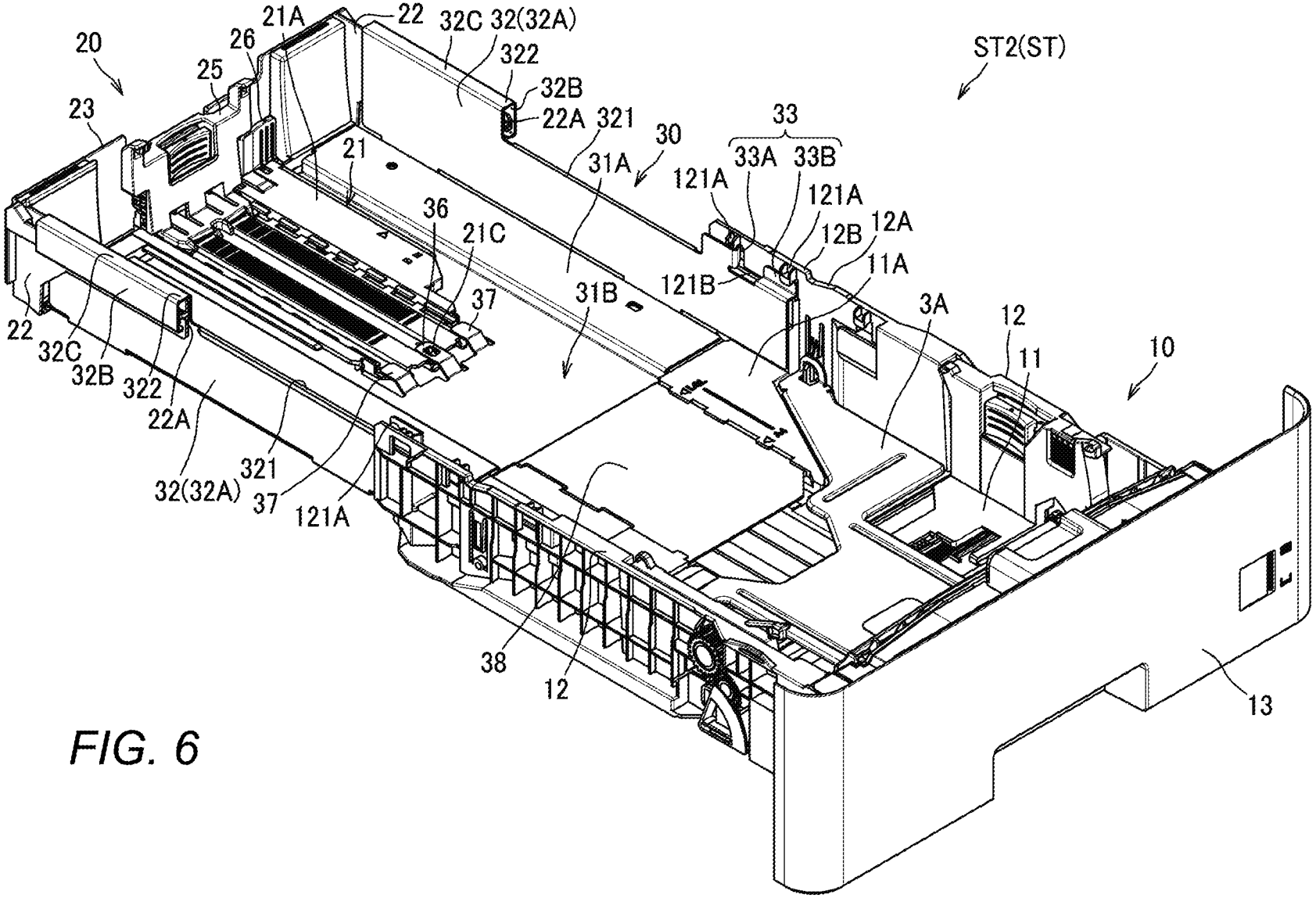
FIG. 6 is a perspective view of the sheet tray in the second state.

As illustrated in FIG. 2, the sheet tray ST is configured to include a first tray 10 which is an example of a first portion, a second tray 20 which is an example of a second portion, and a third tray 30 which is an example of a third portion. The second tray 20 may be directly connected to the first tray 10. The third tray 30 is a member that connects the first tray 10 to the second tray 20, and is directly connected to the first tray 10 and the second tray 20 in a state where the second tray 20 is disengaged from the first tray 10. As illustrated in FIGS. 5A and 5B, the sheet tray ST is arranged into a first state (a sheet tray in this state is denoted by a reference numeral ST1) in which the first tray 10 and the second tray 20 are directly connected to each other, and a second state (a sheet tray in this state is denoted by a reference numeral ST2) in which the third tray 30 is positioned between the first tray 10 and the second tray 20 and the third tray 30 connects the first tray 10 to the second tray 20 as illustrated in FIG. 6.

The sheet tray ST1 in the first state may accommodate with the sheet S with a first size. Meanwhile, the sheet tray ST2 in the second state may accommodate the sheet S having a second size that is longer than the sheet S having the first size.

Figure 3:
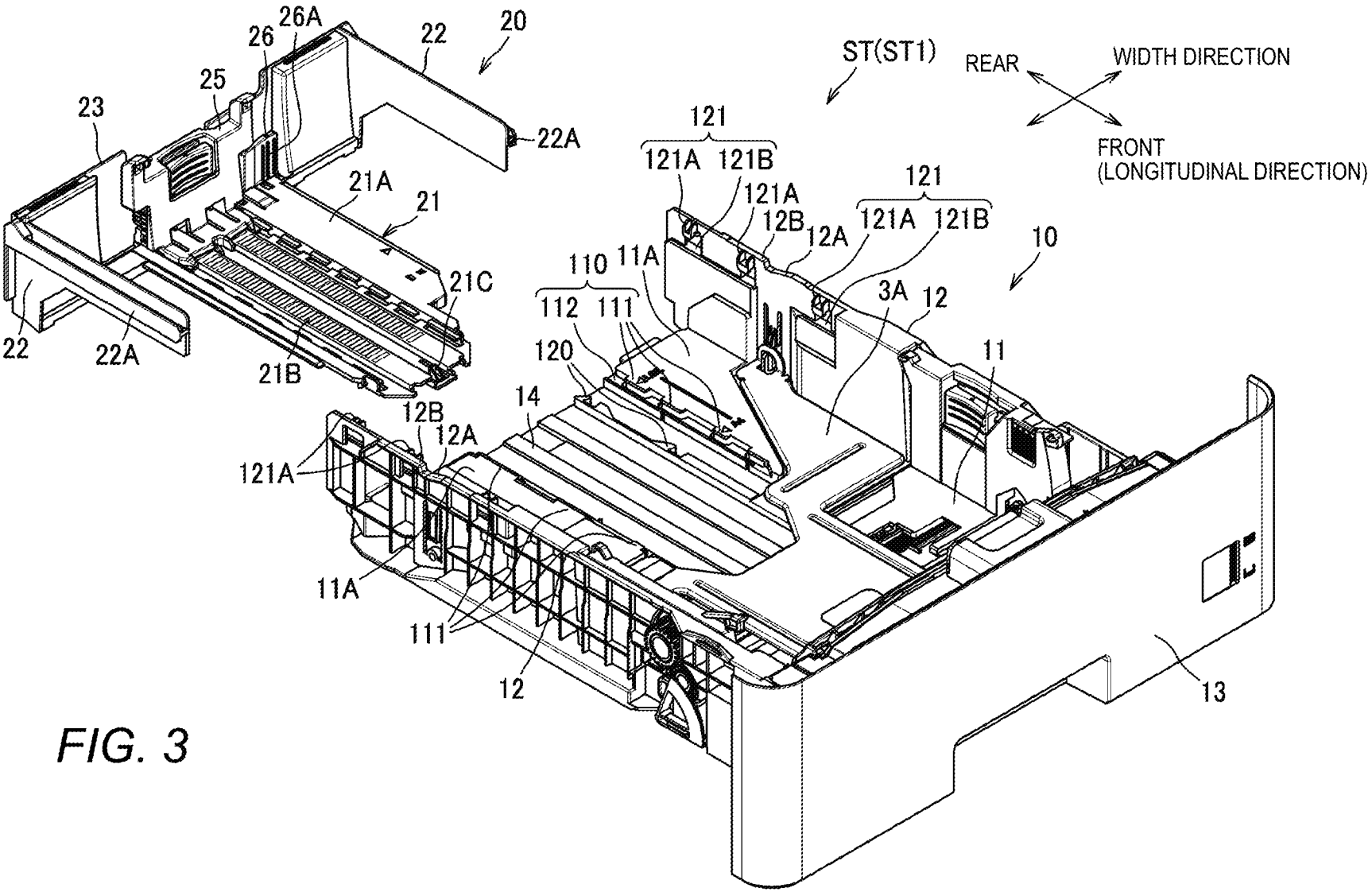
FIG. 3 is an exploded perspective view of the sheet tray in a first state.

As illustrated in FIG. 3, the first tray 10 include a bottom plate 11, a pair of first side walls 12, and a front panel 13. The pair of first side walls 12 are disposed in end portions of the first tray 10 in a width direction (hereinafter, the width direction of the sheet S is simply referred to as a "width direction") orthogonal to a longitudinal direction (hereinafter, the longitudinal direction of the sheet S is a front-back direction of FIG. 3 and is simply referred to as a "longitudinal direction") of the sheet S. Specifically, the pair of first side walls 12 extend upward from the end portion of the bottom plate 11 in the width direction. The front panel 13 connects front ends of the pair of first side walls 12 to the front end of the bottom plate 11 and configures the front surface of the device main body 2.

The pressure plate 3A is disposed along the upper surface of the bottom plate 11 of the first tray 10. The pressure plate 3A may swing up and down with a trailing end which is an end portion far from the front panel 13 as a supporting point.

In the first tray 10, the pressure plate 3A is formed of a metal plate, and the others are configured with plastic.

In an end portion of the bottom plate 11 which is far from the front panel 13, the first tray 10 includes first support surfaces 11A that support the sheet S from below. The first support surfaces 11A are provided in both end portions in the width direction.

A tray guide 14 that is engaged with a guide rail 21 of the second tray 20 and slides is provided between the first support surfaces 11A. A plurality of grooves that are engaged with the lower surface of the guide rail 21 and extend in the longitudinal direction are provided on the upper surface of the tray guide 14.

In a boundary between the first support surface 11A and the tray guide 14, the first tray 10 includes a fitting unit 110 that engages with the upper surface and the lower surface of the guide rail 21. The fitting unit 110 includes a plurality of upper surface engagement units 111 that protrude from the end portion of the first support surface 11A toward the central portion of the bottom plate 11 in the width direction and a lower surface engagement unit 112 that is an end portion of the tray guide 14 on the outside in the width direction and disposed to be apart from the upper surface engagement units 111 so that the guide rail 21 may be received between the upper surface engagement units 111.

The first tray 10 is provided with a plurality of positioning protrusions 120 that protrude upward from the upper surface of the tray guide 14 and protrude outward in the width direction. The positioning protrusions 120 may be engaged with a lock unit 26B (see FIG. 7) described below.

Each of the pair of first side walls 12 include a recess 12A and a first drawing restriction unit 12B at the upper edge. The first drawing restriction unit 12B is adjacent to the recess 12A on the rear side. Therefore, the first drawing restriction unit 12B protrudes relatively upward compared with the recess 12A. The first drawing restriction unit 12B comes into contact with a stopper 2R (see FIG. 8) of the device main body 2 of the image forming device 1 to have a function of stopping drawing of the sheet tray ST1 from the device main body 2.

Each of the pair of first side walls 12 is provided with slide guides 121 that guide the slide movement of the second tray 20 with respect to the first tray 10. The slide guides 121 include upper guides 121A that protrude from the side surfaces of the pair of first side walls 12 in trailing end portions on the inner side in the width direction, and lower guides 121B that are disposed under the upper guides 121A and vertically face the upper guides 121A each other. According to the present embodiment, three upper guides 121A are provided side by side in the longitudinal direction.

The second tray 20 includes the guide rail 21, a pair of second side walls 22, a rear panel 23, an end guide 25, and a lock member 26. The second tray 20 is mainly made of plastic.

The guide rail 21 corresponds to a bottom plate of the second tray 20 and includes a second support surface 21A that supports the sheet S from below. The guide rail 21 is a member that guides the end guide 25 restricting the position of the trailing end of the sheet S so as to be slidable in the longitudinal direction. The guide rail 21 includes a plurality of fine grooves 21B arranged in the longitudinal direction on the upper surface.

The guide rail 21 engages with the tray guide 14 of the first tray 10 and thus is slidable in the longitudinal direction with respect to the first tray 10. When the guide rail 21 engages with the fitting unit 110 of the first tray 10, the movement of the guide rail 21 to the first tray 10 in the vertical direction is restricted by the upper surface engagement units 111 and the lower surface engagement unit 112 of the fitting unit 110.

The end guide 25 is a member that guides a longitudinal end of the sheet S. The end guide 25 engages with the guide rail 21 so as to be slidable in the longitudinal direction. The end guide 25 selectively engages with a portion of the grooves 21B to define the position with respect to the guide rail 21 in the longitudinal direction.

In the end portion close to the front panel 13 on the upper surface, the guide rail 21 includes a protrusion 21C that restricts the slide of the end guide 25. When the end guide 25 moves in a direction close to the front panel 13, the protrusion 21C comes into contact with the end guide 25 and restricts further forward movement of the end guide 25.

The pair of second side walls 22 are disposed in the end portions in the width direction of the second tray 20. Each of the second side walls 22 includes a slide rail 22A that extends forward in an elongated manner. The slide rail 22A may engage with the slide guide 121 to be sandwiched between the upper guide 121A and the lower guide 121B of the slide guide 121. When the slide rail 22A engages with the slide guide 121, the slide movement of the second tray 20 with respect to the first tray 10 is guided. Accordingly, the second tray 20 is slidable with respect to the first tray 10 between the first position and the second position in the first state of being directly connected to the first tray 10.

Specifically, as illustrated in FIG. 5A, in the sheet tray ST1 in the first state, the second tray 20 may move to the first tray 10 between the first position that is the closest to the front panel 13 and the second position that is the farthest from the front panel 13 as illustrated in FIG. 5B.

When the second tray 20 is in the first position, the sheet tray ST1 may accommodate the sheet S with the first size. When the second tray 20 is in the second position, the sheet tray ST1 may accommodate the sheet S with the third size that is longer than the first size and shorter than the second size.

Figure 7:
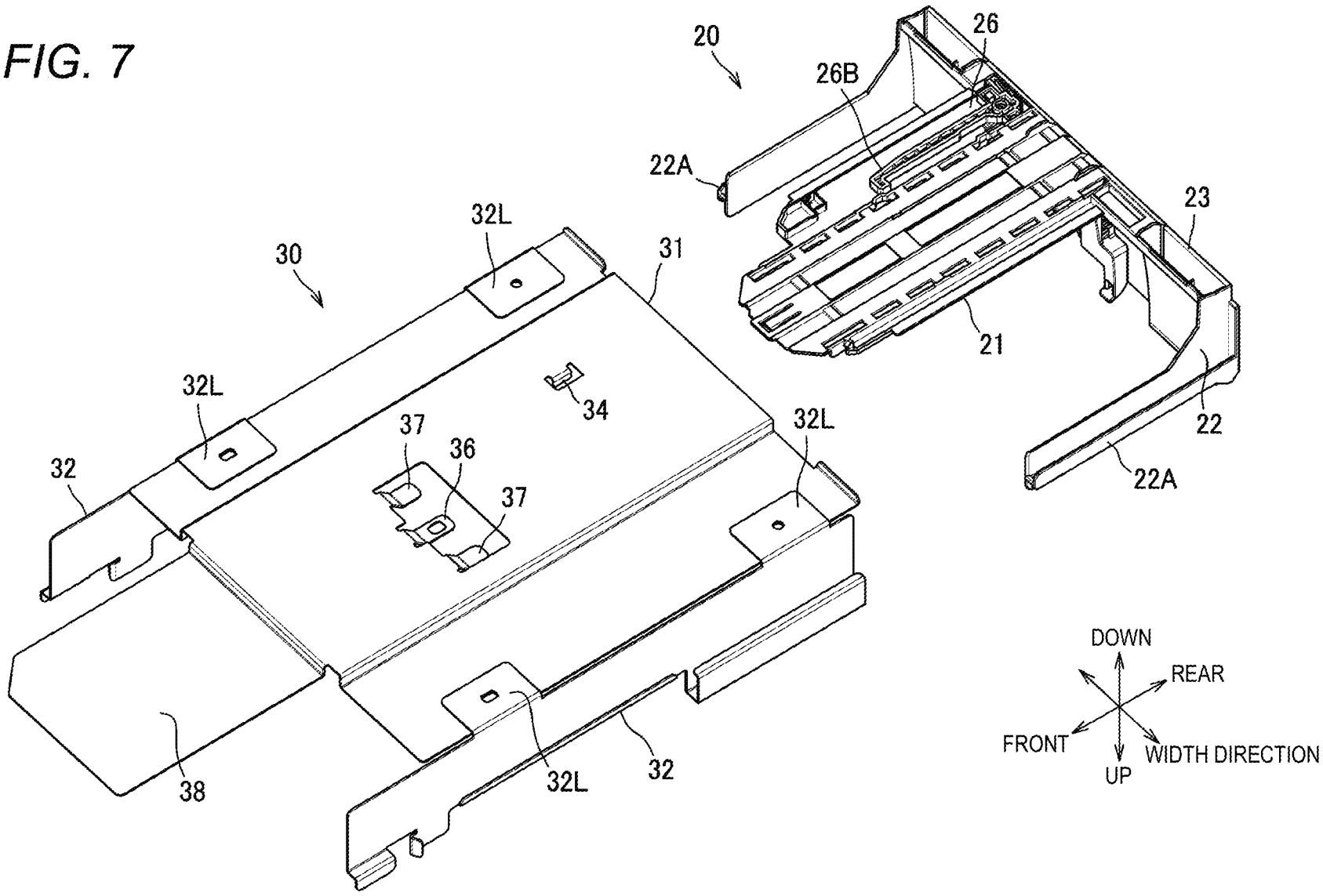
FIG. 7 is a perspective view of the second tray and the third tray as seen from below.

As illustrated in FIG. 7, the lock member 26 includes an operation unit 26A (see FIG. 3) and the lock unit 26B. The operation unit 26A and the lock unit 26B are integrally configured. The operation unit 26A is disposed on the upper side of the guide rail 21, and the lock unit 26B is disposed on the lower side of the guide rail 21. The lock unit 26B extends long in the longitudinal direction. A hook shape protruding in the width direction is formed at the front end of the lock unit 26B. The operation unit 26A may be pushed in a direction of coming close to the rear panel 23. When the operation unit 26A is pushed, the lock unit 26B swings in the width direction.

Referring back to FIG. 3, in a state where the second tray 20 is directly connected to the first tray 10, the lock unit 26B may engage with the positioning protrusions 120 which is a portion of the first tray 10 (the engaged state is not illustrated) in order to lock the position with respect to the first tray 10.

As illustrated in FIG. 2, the third tray 30 mainly includes a bottom plate 31, a pair of third side walls 32, and a connection unit 38. The third tray 30 is made of a metal plate.

The bottom plate 31 is provided with a recess 31B recessed downward at the center in the width direction and includes third support surfaces 31A that support the sheet S from below on both sides of the recess 31B in the width direction. The recess 31B is recessed downward with respect to the third support surfaces 31A.

A projection 34, an engagement member 36, and pressing units 37 are provided on the bottom surface of the recess 31B.

The projection 34 is disposed in the rear portion of the bottom plate 31. The projection 34 is formed to protrude upward by cutting and raising a portion of the bottom plate 31. When the second tray 20 is connected to the third tray 30, the lock unit 26B of the second tray 20 engages with the projection 34. Accordingly, the position of the second tray 20 with respect to the third tray 30 in the longitudinal direction is locked.

The engagement member 36 and the pressing units 37 are disposed in front of the projection 34. Both of the engagement member 36 and the pressing units 37 are formed by cutting and raising the bottom plate 31 and protrude from the bottom surface of the recess 31B.

Figure 4:
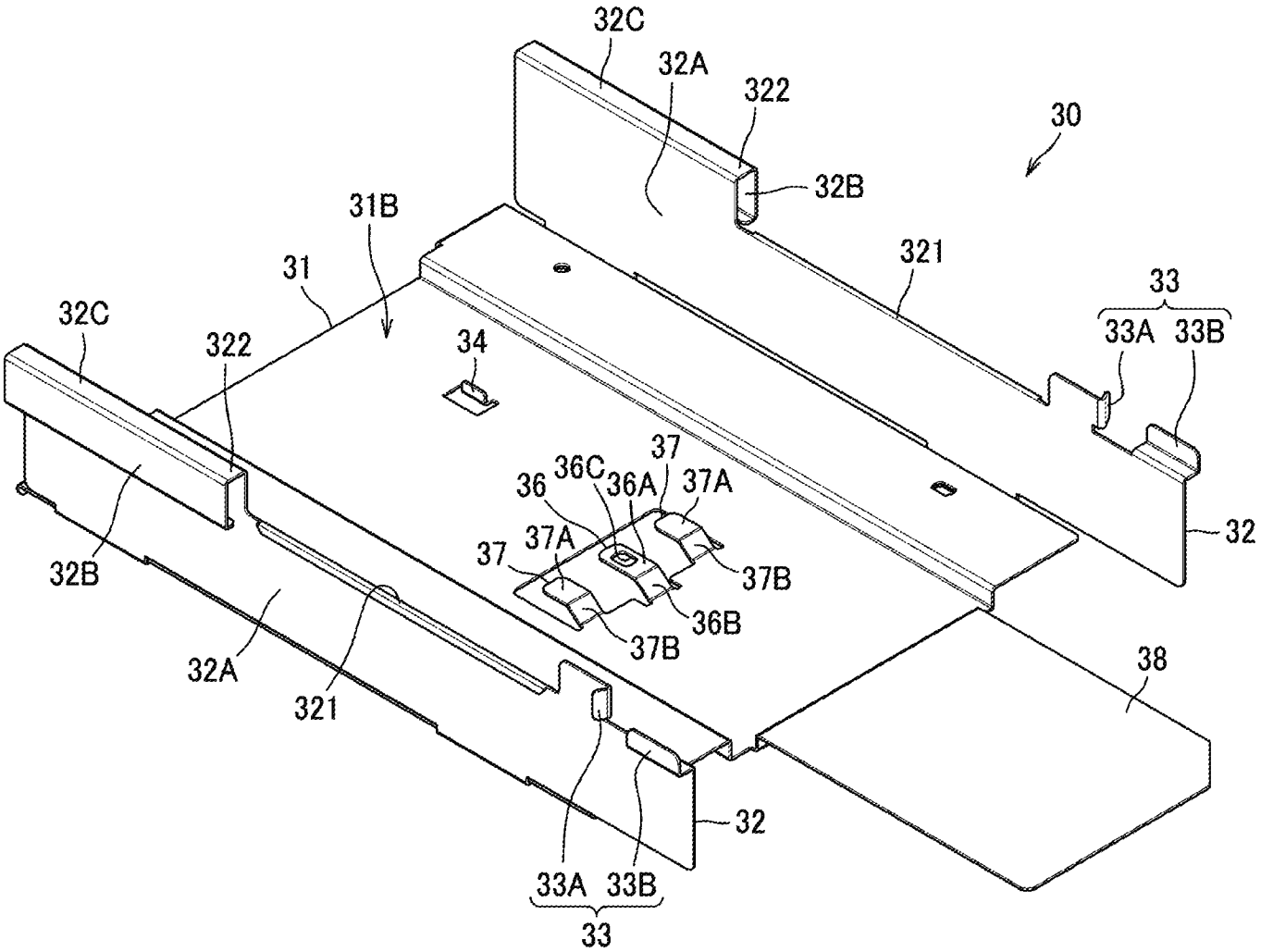
FIG. 4 is a perspective view of a third tray.

The engagement member 36 engages with the protrusion 21C of the second tray 20. More specifically, as illustrated in FIG. 4, the engagement member 36 includes an engagement unit 36A that engages with the protrusion 21C and an inclined portion 36B that links the engagement unit 36A with the bottom surface of the recess 31B and is positioned downward as it is closer to the connection unit 38. A hole 36C that the protrusion 21C enters is formed in the engagement unit 36A. As illustrated in FIG. 6, the second tray 20 is connected to the third tray 30 by inserting the guide rail 21 to the recess 31B and engaging the protrusion 21C with the engagement member 36.

The pressing units 37 are disposed one by one on both sides of the engagement member 36 in the width direction. The pressing unit 37 abuts to the upper surface in the front end portion of the guide rail 21 and restricts upward movement of the guide rail 21.

The connection unit 38 extends in the longitudinal direction from the front end which is an end of the recess 31B in the longitudinal direction. The upper surface of the connection unit 38 has a height slightly higher than the third support surface 31A. The connection unit 38 is connected to the first tray 10 by being inserted into the fitting unit 110 (FIG. 3) of the first tray 10.

As illustrated in FIG. 4, the pair of third side walls 32 are disposed in the end portions of the third tray 30 in the width direction. The pair of third side walls 32 extend upward from the both end portions of the bottom plate 31 in the width direction. As illustrated in FIG. 7, each of the third side walls 32 includes fixing units 32L that are bent to the inner side in the width direction from the lower end. A pair of the fixing units 32L are provided on each of the third side walls 32 to be apart from each other in the front-rear direction. Each of the fixing units 32L is fixed to the bottom plate 31 by a screw (not illustrated) or the like.

Referring back to FIG. 4, each of the third side walls 32 includes an inner side wall 32A, an outer side wall 32B, an upper wall 32C, a connection unit 33, a recess 321, and a second drawing restriction unit 322.

The outer side walls 32B are positioned on the outer side than the inner side walls 32A in the width direction, and the upper walls 32C link the upper ends of the inner side walls 32A and the upper ends of the outer side walls 32B. As illustrated in FIG. 6, in the state where the third tray 30 is connected to the second tray 20, the slide rail 22A which is a portion of the second side wall 22 of the second tray 20 is inserted between the inner side wall 32A and the outer side wall 32B. Therefore, in the state where the third tray 30 is connected to the second tray 20, the inner side walls 32A are positioned on the inner sides of the second side walls 22 in the width direction, the outer side walls 32B are positioned on the outer sides of the second side walls 22 in the width direction, and the upper walls 32C link the inner side walls 32A to the outer side walls 32B on the upper portion of the second side walls 22.

The connection unit 33 includes a positioning unit 33A and a vertical positioning unit 33B.

The positioning unit 33A is a portion having a shape of extending from a front end portion of a portion protruding upward from an upper edge portion of the third side wall 32 to the outer side in the width direction. The positioning unit 33A is inclined in the width direction so that the end portion on the outer side in the width direction is positioned rearward than the end portion on the inner side in the width direction. Therefore, when the third tray 30 is connected to the first tray 10, if the positioning units 33A are from the rear sides of the upper guides 121A, the first side walls 12 are bent to the outer side in the width direction by the inclination of the positioning units 33A, and the positioning units 33A move to the inner side than the upper guides 121A in the width direction and wrap around from the inner side of the upper guides 121A in the width direction toward the front side of the upper guides 121A.

When the third tray 30 is connected to the first tray 10, the positioning units 33A abut the upper guides 121A of the slide guides 121 that are positioned on the most rear side in the longitudinal direction. Specifically, when the third tray 30 is connected to the first tray 10, the positioning units 33A abut the upper guides 121A from the front side, and the drawing of the third tray 30 from the first tray 10 in the longitudinal direction is restricted.

As illustrated in FIG. 4, the vertical positioning unit 33B is a portion having a shape of extending upward from an end portion of a portion extending from the upper edge portion of the third side wall 32 to the outer side in the width direction, on the outer side in the width direction. The vertical positioning unit 33B is positioned in front of the positioning unit 33A. As illustrated in FIG. 6, the vertical positioning unit 33B is fit between the upper guides 121A and the lower guides 121B of the slide guides 121. Accordingly, the movement of the third side wall 32 to the first side wall 12 in the vertical direction is restricted.

Figure 8:
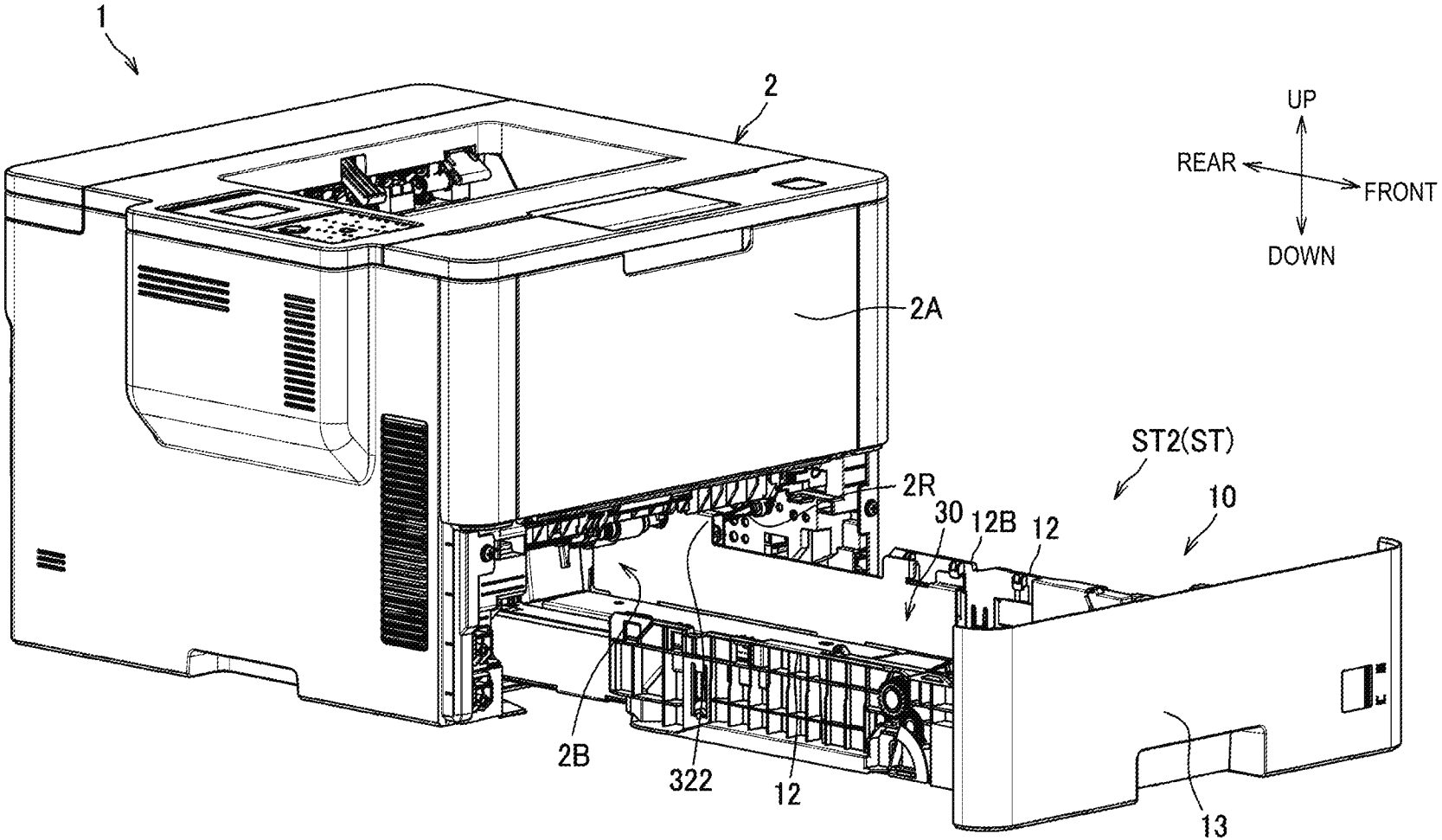
FIG. 8 is a perspective view of the sheet tray in the second state in a state of being pulled out from a device main body as seen from above.

Referring back to FIG. 4, the recess 321 is positioned on the upper edge of the third side wall 32. The second drawing restriction unit 322 is adjacent to the rear side of the recess 321. Therefore, the second drawing restriction unit 322 protrudes relatively upward compared with the recess 321. As illustrated in FIG. 8, the second drawing restriction unit 322 comes into contact with the stopper 2R of the device main body 2 to have a function of stopping the drawing of the sheet tray ST2 from the device main body 2.

As illustrated in FIG. 6, in the second state where the third tray 30 connects the first tray 10 to the second tray 20, the heights of the first support surfaces 11A, the third support surface 31A, and the second support surface 21A decrease in this order.

Figure 9:
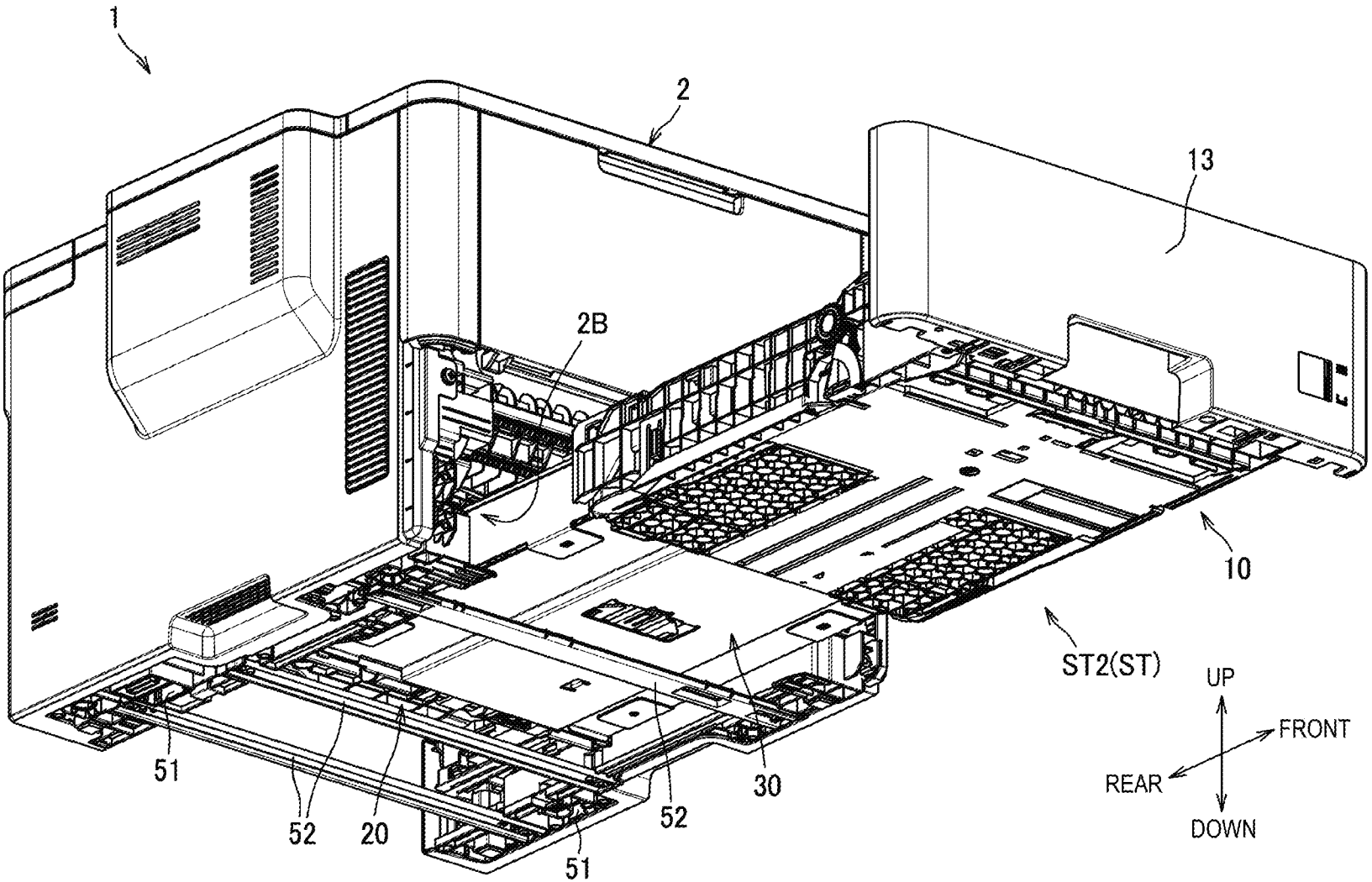
FIG. 9 is a perspective view of the sheet tray in the second state in a state of being pulled out from the device main body as seen from below.

As illustrated in FIG. 9, the image forming device 1 includes a pair of side frames 51 and an underbar 52.

The pair of side frames 51 are disposed to be apart from each other in the width direction orthogonal to the longitudinal direction of the sheet S.

The underbar 52 is bridged to link the lower portions of the pair of side frames 51 and is electrically grounded. Three underbars 52 are provided to be apart from each other in the front-back direction. When the sheet tray ST2 in the second state is mounted on the mounting unit 2B, the third tray 30 may come into contact with the underbar 52.

Figure 10:
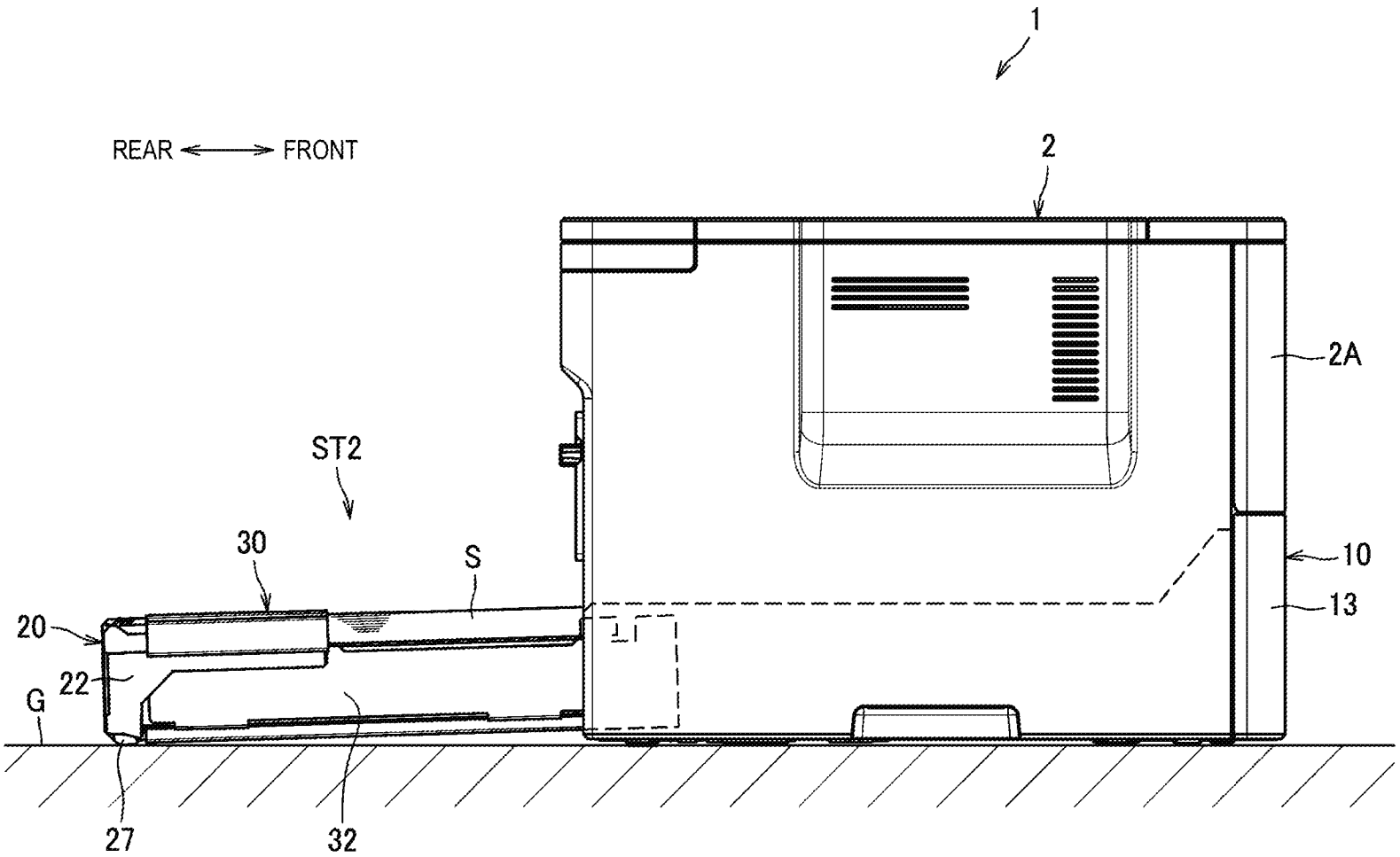
FIG. 10 is a side view of the sheet tray in the second state in a state of being mounted to the device main body.

As illustrated in FIG. 10, when the sheet tray ST2 in the second state is in the state of being mounted on the device main body 2 of the image forming device 1, the third tray 30 is disposed over the inner side and the outer side of the device main body 2. Specifically, the front end portion of the third tray 30 is positioned on the inner side of the device main body 2, the trailing end portion of the third tray 30 is positioned on the outer side of the device main body 2.

In a state where a maximum amount of the sheets S are stacked in the sheet tray ST2 in the second state, and the sheet tray ST2 in the second state is mounted in the device main body 2 of the image forming device 1, a lower end unit 27 of the second tray 20 comes into contact with a flat installation surface G on which the device main body 2 is installed. When the sheet tray ST2 is mounted on the device main body 2 in a state were the sheet S is not stacked, the lower end unit 27 may or may not come into contact with the installation surface G. Even when the lower end unit 27 does not come into in contact with the installation surface G, if a maximum amount of the sheets S are stacked in the sheet tray ST2, the sheet tray ST2 is slightly bent, so that the lower end unit 27 of the second tray 20 comes into contact with the installation surface G.

According to the sheet tray ST and the image forming device 1 as described above, the following effects may be achieved.

Since the sheet tray ST of the present embodiment is set to the sheet tray ST1 in the first state by directly connecting the first tray 10 to the second tray 20, a short sheet having the first size may be accommodated. Since the sheet tray ST is set to the sheet tray ST2 in the second state by connecting the first tray 10 to the second tray 20 with the third tray 30, the sheet tray ST2 is lengthened, so that a long sheet having the second size may be accommodated. Since the third tray 30 is made of metal, even when the first tray 10 is connected to the second tray 20 with the third tray 30, the rigidity of the sheet tray ST2 may be increased.

With respect to the sheet tray ST, the connection unit 38 is inserted to the fitting unit 110 by using the fitting unit 110 using the connection of the first tray 10 to the second tray 20, so that the first tray 10 and the third tray 30 are connected to each other. Therefore, the sheet tray ST may be easily rearranged to the first state and the second state.

With respect to the sheet tray ST, the second tray 20 and the third tray 30 may be positioned by using the protrusion 21C that restricts the sliding of the end guide 25.

With respect to the sheet tray ST, when the sheet S is stacked from the first tray 10 to the second tray 20 in the sheet tray ST2 in a state where the first tray 10 is connected to the second tray 20 with the third tray 30, the sheet S is lifted with the inclined portion 36B, and thus the sheet S is hardly caught by the engagement member 36. That is, the sheet S may be smoothly stacked in the sheet tray ST2.

The pressing unit 37 suppresses the twist of the second tray 20 with respect to the third tray 30. That is, the rigidity of the sheet tray ST2 in the second state may be increased.

When the sheet is stacked from the first tray 10 to the second tray 20 on the sheet tray ST2 in the second state, the heights of the first support surfaces 11A, the third support surface 31A, and the second support surface 21A decrease in this order, and thus the sheet S is hardly caught in a seam of each support surface.

The position of the second tray 20 with respect to the third tray 30 in the longitudinal direction may be locked by using the lock unit 26B that locks the position of the second tray 20 with respect to the first tray 10.

The third tray 30 may be positioned with respect to the first tray 10 in the longitudinal direction by using the slide guide 121 that guides the slide movement of the second tray 20 with respect to the first tray 10.

Since the third tray 30 includes the pair of third side walls 32 in the end portion in the width direction, the rigidity of the third tray 30 may be increased. The third side wall 32 includes the inner side wall 32A, the outer side wall 32B, and the upper wall 32C, and these surround the second side wall 22, so that the rigidity of the sheet tray ST2 in the second state may be increased.

The drawing of the sheet tray ST2 may be stopped by using the stopper 2R that stops the drawing of the sheet tray ST1.

When the maximum amount of the sheets S are stacked in the sheet tray ST2, the lower end unit 27 of the second tray 20 comes into contact with the installation surface G, and thus the weight of the sheet tray ST2 in which the sheets S are stacked may be received by the installation surface G via the second tray 20. Therefore, the excessive bending of the sheet tray ST2 may be recuded.

When the sheet tray ST2 is mounted on the mounting unit 2B, the third tray 30 comes into contact with the underbar 52, so that the electric charge accumulated in the third tray 30 may be discharged.

Although the embodiments of the present invention are described above, the present invention is not limited to the above embodiments. The specific configuration may be changed as appropriate without departing from the spirit of the present invention.

For example, in the above embodiment, the first tray 10, the second tray 20, and the third tray 30 may be separated from each other, but may be an inseparable integral structure. For example, the sheet tray may be configured to include a first portion made of plastic which is positioned on the inner side of the device main body, a second portion made of plastic which is positioned on the outer side of the device main body, and a third portion which is positioned between the first portion and the second portion over the inner side and the outer side of the device main body. Even in this case, since the third portion is made of metal, high rigidity of the sheet tray may be secured by the third portion. Therefore, even when a long sheet is stacked on the sheet tray, the sheet may be stably supported.

Figure 11:
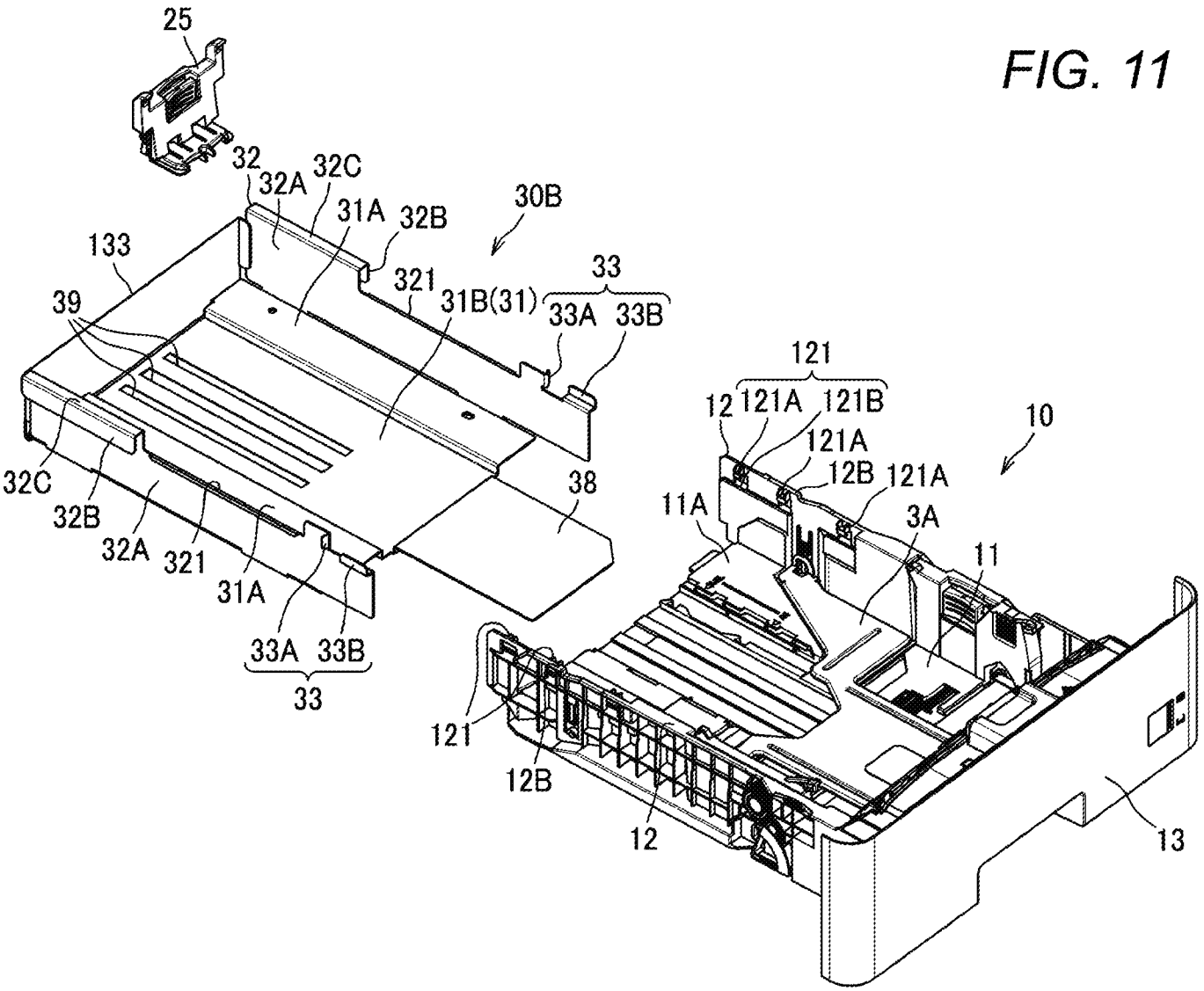
FIG. 11 is an exploded perspective view of a sheet tray according to a modified example.

According to the embodiment, it is configured that the sheet having the second size may be accommodated in the second state where the third tray 30 connects the first tray 10 to the second tray 20, but a third state that may accommodate the sheet having the second size may be set by detaching the second tray 20 from the sheet tray in the first state and directly connecting the third tray 30B to the first tray 10 instead of the second tray 20 as illustrated in FIG. 11. In this case, the third tray 30B integrally includes a rear panel 133. In this form, the bottom plate 31 does not need the projection 34, the engagement member 36, and the pressing units 37. Instead, rail holes 39 that guide slide movement of the end guide 25 are desirably formed in the bottom plate 31.

According to the embodiment, when a maximum amount of the sheets S are stacked on the sheet tray ST2 in the second state, the second tray 20 comes into contact with the installation surface G, but the third tray 30 may come into contact with the installation surface G. Also in this case, since the installation surface G receives the weight of the sheets S via the third tray 30, the excessive bending of the sheet tray ST2 may be reduced.

In the embodiment, the first drawing restriction units are provided on both of the pair of first side walls, but the first drawing restriction unit may be provided on one side. In the same manner, the second drawing restriction units are provided on both of the pair of third side walls, but the second drawing restriction unit may be provided on one side.

In the embodiment, a laser printer is exemplified as an example of the image forming device to which the sheet tray is applied, but the image forming device may be, for example, a copying machine or a multi function device.

Each element of the embodiment and modified examples may be appropriately combined to be implemented.

What is claimed is:

1. A sheet tray configured to accommodate a sheet comprising:

a first tray;

a second tray directly connectable to the first tray; and a third tray directly connectable to the first tray and to the second tray in a state where the second tray is disengaged from the first tray, the third tray being made of metal, wherein the sheet tray configured to take a first state where the first tray is directly connected to the second tray and a second state where the third tray connects the first tray to the second tray, the sheet tray being configured to accommodate a sheet having a first size in the first state and a sheet having a second size longer than the sheet having the first size in the second state.

2. The sheet tray according to claim 1, wherein the second tray includes an end guide that guides an end of a sheet in a longitudinal direction and a guide rail configured to guide movement of the end guide in the longitudinal direction, the first tray includes a fitting unit that engages with an upper surface and a lower surface of the guide rail, and the third tray includes a connection unit inserted into the fitting unit to be connected to the first tray.

3. The sheet tray according to claim 2, wherein the second tray includes a protrusion that restricts sliding of the end guide on an upper surface, the third tray includes a recess provided on a bottom plate and an engagement member that protrudes from a bottom surface of the recess, and the second tray is connected to the third tray by being inserted to the recess so that the protrusion is engaged with the engagement member.

4. The sheet tray according to claim 3, wherein the engagement member includes an engagement unit that engages with the protrusion and an inclined portion that links the engagement unit with the bottom surface of the recess and is positioned downward as it is closer to the connection unit.

5. The sheet tray according to claim 3, wherein the third tray includes pressing units that abut an upper surface of the guide rail on both sides of the engagement member in a width direction orthogonal to a longitudinal direction of the sheet.

6. The sheet tray according to claim 1, wherein the first tray includes a first support surface configured to support the sheet from below, the second tray includes a second support surface configured to support the sheet from below, the third tray includes a third support surface configured to support the sheet from below, and in the second state, heights of the first support surface, the third support surface, and the second support surface decrease in this order.

7. The sheet tray according to claim 1, wherein the second tray is slidable with respect to the first tray between a first position and a second position in the first state, and when the second tray is in the first position, the sheet having the first size is accommodable, and when the second tray is in the second position, a sheet having a third size which is longer than the first size and shorter than the second size is configured to be accommodable.

8. The sheet tray according to claim 7, wherein the second tray includes a lock unit configured to engage with a portion of the first tray to lock a position of the second tray with respect to the first tray in the first state, the third tray includes a projection that protrudes upward, and when the second tray is connected to the third tray, the lock unit engages with the projection, and a position of the sheet in a longitudinal direction with respect to the third tray is locked.

9. The sheet tray according to claim 7, wherein the first tray includes a pair of first side walls in an end portion in a width direction orthogonal to a longitudinal direction of the sheet, the pair of first side walls are provided with slide guides configured to guide slide movement of the second tray with respect to the first tray, and when the third tray is connected to the first tray, the third tray includes positioning units configured to abut the slide guides, respectively, in the longitudinal direction.

10. The sheet tray according to claim 1, wherein the second tray includes a pair of second side walls in an end portion in a width direction orthogonal to a longitudinal direction of the sheet, the third tray includes a pair of third side walls in an end portion in the width direction, and in a state where the third tray is connected to the second tray, each of the pair of third side walls includes an inner side wall positioned on an inner side of the second side wall in the width direction, an outer side wall positioned on an outer side of the second side wall in the width direction, and an upper wall configured to link the inner side wall with the outer side wall at an upper side of the second side wall.

11. The sheet tray according to claim 1, wherein the first tray includes a pressure plate that lifts the sheet.

12. The sheet tray according to claim 1, wherein the third tray is disposed across an inner side and an outer side of a device main body in a state where the sheet tray in the second state is mounted on the device main body of an image forming device.

13. The sheet tray according to claim 1, wherein the first tray includes a pair of first side walls in an end portion in a width direction orthogonal to a longitudinal direction of the sheet, the third tray includes a pair of third side walls in an end portion in the width direction, at least one of the pair of first side walls includes a first drawing restriction unit that protrudes upward at an upper edge of the first side wall, the first drawing restriction unit comes into contact with a stopper of a device main body of an image forming device and stops drawing of the sheet tray in the first state from the device main body, and at least one of the pair of third side walls includes a second drawing restriction unit that protrudes upward at an upper edge of the third side wall, and the second drawing restriction unit comes into contact with the stopper and stops drawing of the sheet tray in the second state from the device main body.

14. The sheet tray according to claim 1, wherein, in a state where a maximum amount of sheets are stacked on the sheet tray in the second state and the sheet tray in the second state is mounted on a device main body of an image forming device, a lower end of the second tray or the third tray is at a same vertical level as a lowermost portion of the device main body.

15. An image forming device comprising:

the sheet tray according to claim 1, and a device main body that includes a mounting unit on which the sheet tray is mounted, wherein the image forming device includes a pair of side frames disposed apart from each other in a width direction orthogonal to a longitudinal direction of a sheet and an electrically grounded underbar configured to be bridged to link lower portions of the pair of side frames, and when the sheet tray in the second state is mounted on the mounting unit, the third tray is configured to come into contact with the underbar.

16. A sheet tray configured to accommodate a sheet comprising:

a first tray;

a second tray directly connectable to the first tray; and a third tray directly connectable to the first tray in a state where the second tray is disengaged from the first tray, the third tray is made of metal, wherein, the sheet tray configured to take a first state where the second tray is directly connected to the first tray and a third state where the third tray is directly connected to the first tray, the sheet tray being configured to accommodate a sheet having a first size in the first state and a sheet having a second size longer than the sheet having the first size in the third state.

* * * * *